US008510242B2

(12) United States Patent
Al-Fattah

(10) Patent No.: US 8,510,242 B2
(45) Date of Patent: Aug. 13, 2013

(54) ARTIFICIAL NEURAL NETWORK MODELS FOR DETERMINING RELATIVE PERMEABILITY OF HYDROCARBON RESERVOIRS

(75) Inventor: Saud Mohammad A. Al-Fattah, Dammam (SA)

(73) Assignee: Saudi Arabian Oil Company, Dhahram (SA)

( * ) Notice: Subject to any disclaimer, the term of this patent is extended or adjusted under 35 U.S.C. 154(b) by 648 days.

(21) Appl. No.: 12/733,357

(22) PCT Filed: Aug. 27, 2008

(86) PCT No.: PCT/US2008/010285

§ 371 (c)(1),
(2), (4) Date: Feb. 23, 2010

(87) PCT Pub. No.: WO2009/032220

PCT Pub. Date: Mar. 12, 2009

(65) Prior Publication Data

US 2010/0211536 A1 Aug. 19, 2010

(51) Int. Cl.
*G06F 15/18* (2006.01)
*G06N 7/06* (2006.01)

(52) U.S. Cl.
USPC ..... 706/21; 706/929

(58) Field of Classification Search
USPC ..... 706/21
See application file for complete search history.

(56) References Cited

U.S. PATENT DOCUMENTS

| | | | |
|---|---|---|---|
| 6,321,179 | B1 | 11/2001 | Glance |
| 6,424,919 | B1 | 7/2002 | Moran |
| 2004/0199482 | A1 | 10/2004 | Wilson |
| 2007/0016389 | A1 | 1/2007 | Ozgen |

OTHER PUBLICATIONS

Mohaghegh et al., SPE 28394 A Methodological Approach for Reservoir Heterogeneity Characterization Using Artificial Neutral Networks. [online], 1994 [retrieved on Nov. 2, 2012]. Retrieved from the Internet:<URL:http://bluecoat-02/?cfru=aHR0cDovL3d3dy5wZS53dnUuZWR1L1B1YmxpY2F0aW9ucy9QZGZzLzl4Mzk0LnBkZg==SPE 28394>.*

Search Report and Written Opinion for related PCT/US2008/010285, mailed Nov. 21, 2008, 8 pages.

Honarpour, M., Koederitz, L., and Harvey, A.H., "Empirical Equations for Estimating Two-Phase Relative Permeability in Consolidated Rock," JPT 34 (12): 2905-2908, SPE-9966-PA, DOI: 10.2118/9966-PA, 1982.

(Continued)

*Primary Examiner* — Jeffrey A Gaffin
*Assistant Examiner* — Nathan Brown, Jr.
(74) *Attorney, Agent, or Firm* — Abelman, Frayne & Schwab

(57) ABSTRACT

A system and method for modeling technology to predict accurately water-oil relative permeability uses a type of artificial neural network (ANN) known as a Generalized Regression Neural Network (GRNN) The ANN models of relative permeability are developed using experimental data from waterflood core test samples collected from carbonate reservoirs of Arabian oil fields Three groups of data sets are used for training, verification, and testing the ANN models Analysis of the results of the testing data set show excellent correlation with the experimental data of relative permeability, and error analyses show these ANN models outperform all published correlations

21 Claims, 9 Drawing Sheets

Flowchart of procedure of ANN design

(56) References Cited

OTHER PUBLICATIONS

Ali, J.K., et al., "A Knowledge-Based System for the Identification and Generation of Relative Permabilities of Reservoir Rocks," SPE 36009, Society of Petroleum Engineers, Petroleum Compuer Conference, Jun. 2-5, 1996, Dallas, Texas, pp. 219-228.
Mohamad Ibrahim, M.N., et al., "Two-Phase Relative Permeability Prediction Using a Linear Regression Model" SPE 65631, 2000 SPE Eastern Regional Meeting, Morgantown, West Virginia, Oct. 17-19, 2000, pp. 1-11.
Kjosavik, A., et al., "Relative Permeability Correlation for Mixed-West Reservoirs," SPE 77328, SPE Journal, Mar. 2002, pp. 49-58.
Mohaghegh, S.D., "Virtual Intelligence Applications in Petroleum Engineering: Part 1—Artificial Neural Networks," Journal of Petroleum Technology, Distinguished Author Series, Sep. 2000, pp. 64-73.
Mohagheg, S.D., "An Intelligent Systems Approach to Reservoir Characterization," U.S. Dept. Energy Final Report, Aug. 2005, pp. 1-102.
Artun, E., et al., "Reservoir Characterization Using Intelligent Seismic Inversion," Society of Petroleum Engineers, SPE Eastern Regional Meeting, Sep. 14-16, 2005, Morgantown, West Virginia, SPE 98012, pp. 1-18.
Silva, P.C. et al., "Evaluation of Neuro-Simulation Techniques as Proxies to Reservoir Simulator," Instituto Brasileiro de Petroleo e Gas (IBP1342_06), 2006, pp. 1-8.
Alrumah, M., "Neural Networks Predict Well Inflow Performance," Thesis, Texas A&M University, Dec. 2003, pp. 1-75.
Mohaghegh, S.D., "Petroleum Reservoir Characterization with the Aid of Artificial Neural Networks," Journal of Petroleum Science and Engineering, Dec. 1996, pp. 263-274.

* cited by examiner

-Design of a Generalized Regression Neural Network-

Flowchart of procedure of ANN design

-Results of ANN model compared with experimental data for oil relative permeability.

-Results of ANN model compared with experimental data for oil relative permeability.

-Results of ANN model compared with experimental data for water relative permeability.

-Results of ANN model compared with experimental data for water relative permeability of Well X.

Results of ANN model compared with experimental data for water relative permeability of Well Y A Crossplot of ANN predicted and measured Kro for reservoirs.

A Crossplot of ANN predicted and measured Krw for reservoir

Histogram of Kro residual error for the A reservoir model.

Histogram of Krw residual error for the A reservoir model.

Comparison of ANN model and correlations for predicting Kro for one well in the C field.

Comparison of ANN model and correlations for predicting Krw for one well in the C field.

ARTIFICIAL NEURAL NETWORK MODELS FOR DETERMINING RELATIVE PERMEABILITY OF HYDROCARBON RESERVOIRS

FIELD OF THE INVENTION

This invention relates to artificial neural networks and in particular to a system and method using artificial neural networks to assist in modeling hydrocarbon reservoirs.

BACKGROUND OF THE INVENTION

Determination of relative permeability data is required for almost all calculations of fluid flow in petroleum reservoirs. Water-oil relative permeability data play important roles in characterizing the simultaneous two-phase flow in porous rocks and predicting the performance of immiscible displacement processes in oil reservoirs. They are used, among other applications, for determining fluid distortions and residual saturations, predicting future reservoir performance, and estimating ultimate recovery. Undoubtedly, these data are considered among the most valuable information required in reservoir simulation studies.

Estimates of relative permeability are generally obtained from laboratory experiments with reservoir core samples. Because the protocols for laboratory measurement of relative permeability are intricate, expensive and time consuming, empirical correlations are usually used to predict relative permeability data, or to estimate them in the absence of experimental data. However, prior art methodologies for developing empirical correlations for obtaining accurate estimates of relative permeability data have been of limited success and proven difficult, especially for carbonate reservoir rocks. In comparison, clastic reservoir rocks are more homogeneous in terms of pore size, rock fabric and grain size distribution, and therefore have similar pore size distribution and similar flow conduits. This is difficult because carbonate reservoirs are highly heterogeneous due to changes of rock fabric during diagenetic altercation, chemical interaction, the presence of fossil remains and vugs and dolomitization. This complicated rock fabric, different pore size distribution, leads to less predictable different fluid conduits due to the presence of various pore sizes and rock families.

Artificial neural network (ANN) technology has proved successful and useful in solving complex structure and nonlinear problems. ANNs have seen an expansion of interest over the past few years. They are powerful and useful tools for solving practical problems in the petroleum industry, as described by Mohaghegh. S. D. in "Recent Developments in Application of Artificial Intelligence in Petroleum Engineering", JPT 57 (4): 86-91, SPE-89033-MS, DOI: 10.2118/89033-MS., 2005; and by Al-Fattah, S. M., and Startzman, R. A. in "Neural Network Approach Predicts U.S. Natural Gas Production", SPEPF 18 (2): 84-91, SPE-82411-PA, DOI: 10.2118/82411-PA, 2003. The disclosures of these articles are incorporated herein by reference in their entirety.

Advantages of neural network techniques over conventional techniques include the ability to address highly nonlinear relationships, independence from assumptions about the distribution of input or output variables, and the ability to address either continuous or categorical data as either inputs or outputs. See, for example, Bishop, C., "Neural Networks for Pattern Recognition", Oxford: University Press, 1995; Fausett, L., "Fundamentals of Neural Networks", New York: Prentice-Hall, 1994; Haykin, S., "Neural Networks: A Comprehensive Foundation", New York: Macmillan Publishing, 1994; and Patterson, D., "Artificial Neural Networks", Singapore: Prentice Hall, 1996. The disclosures of these articles are incorporated herein by reference in their entirety. In addition, neural networks are intuitively appealing as they are based on crude, low-level models of biological systems. Neural networks, as in biological systems, learn from examples. The neural network user provides representative data and trains the neural networks to learn the structure of the data.

One type of ANN known to the art is the Generalized Regression Neural Network (GRNN) which uses kernel-based approximation to perform regression, and was described in the above articles by Patterson in 1996 and Bishop in 1995. It is one of the so-called Bayesian networks. GRNN have exactly four layers: input layer, radial centers layer, regression nodes layer, and output layer. As shown in FIG. 1, the input layer has an equal number of nodes as input variables. The radial layer nodes represent the centers of clusters of known training data. This layer must be trained by a clustering algorithm such as Sub-sampling, K-means, or Kohonen training. The regression layer, which contains linear nodes, must have exactly one node more than the output layer. There are two types of nodes: the first type of node calculates the conditional regression for each output variable, whereas the second type of node calculates the probability density. The output layer performs a specialized function such that each node simply divides the output of the associated first type node by that of the second type node in the previous layer.

GRNNs can only be used for regression problems. A GRNN trains almost instantly, but tends to be large and slow. Although it is not necessary to have one radial neuron for each training data point, the number still needs to be large. Like the radial basis function (RBF) network, the GRNN does not extrapolate. It is noted that prior applications of the GRNN-type of ANNs have not been used for relative permeability determination.

SUMMARY OF THE INVENTION

The present invention broadly comprehends a system and method using ANNs and, in particular, GRNN-type ANNs for improved modeling and the prediction of relative permeability of hydrocarbon reservoirs.

A system and method provide a modeling technology to accurately predict water-oil relative permeability using a type of artificial neural network (ANN) known as a Generalized Regression Neural Network (GRNN). In accordance with the invention, ANN models of relative permeability have been developed using experimental data from waterflood core tests samples collected from carbonate reservoirs of large Saudi Arabian oil fields. Three groups of data sets were used for training, verification, and testing the ANN models. Analysis of results of the testing data sets show excellent agreement with the results based on relative permeability of experimental data. In addition, error analyses show that the ANN models developed by the method of the invention outperform all published correlations.

The benefits of this work include meeting the increased demand for conducting special core analysis, optimizing the number of laboratory measurements, integrating into reservoir simulation and reservoir management studies, and providing significant cost savings on extensive lab work and substantial required time.

BRIEF DESCRIPTION OF THE DRAWINGS

Preferred embodiments of the invention are described below and with reference to the drawings wherein.

DETAILED DESCRIPTION OF THE INVENTION

Figure 1:
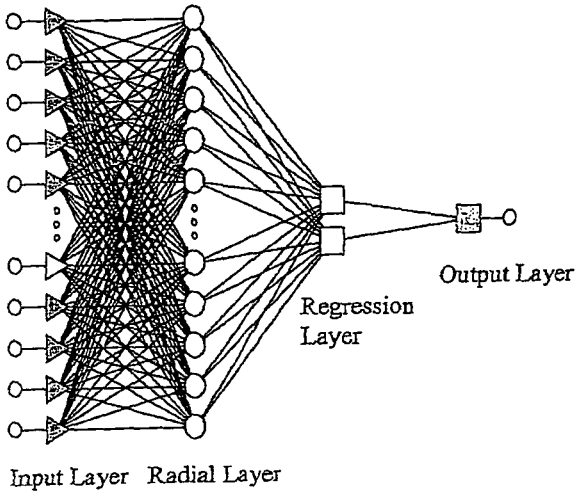
FIG. 1 (PRIOR ART)
FIG. 1 is a schematic illustration of the Generalized Regression Neural Network (GRNN) of the prior art.
Figure 2:
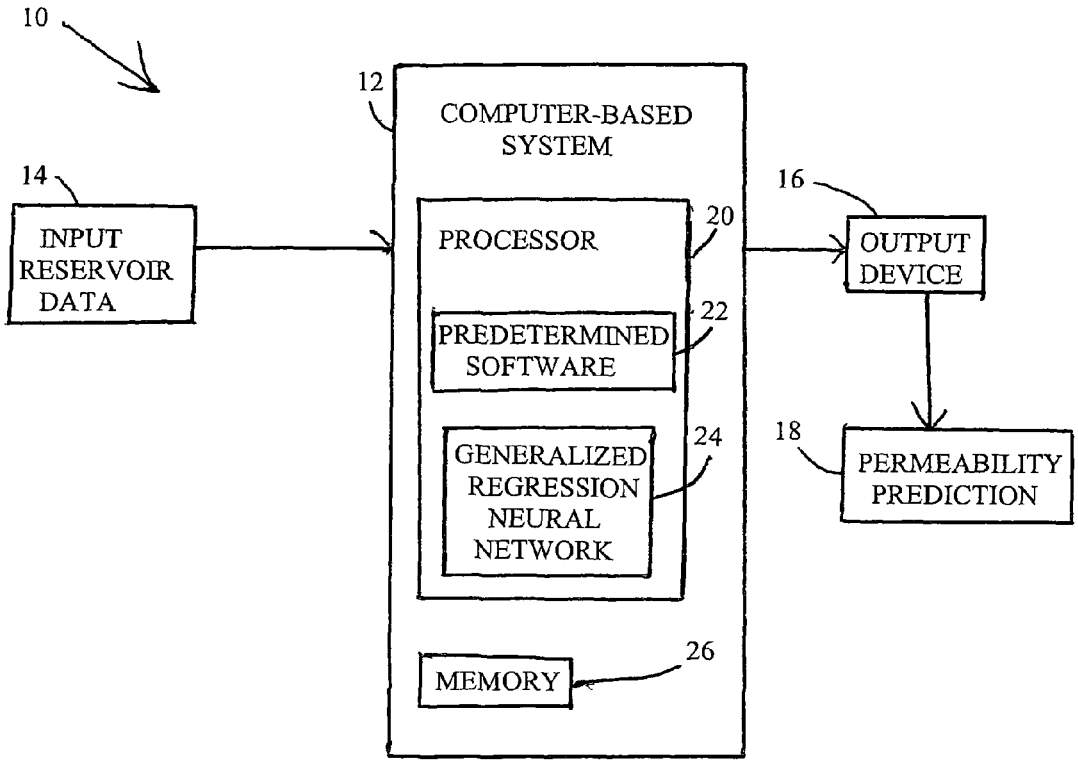
FIG. 2 is a schematic illustration of the system of the present invention which uses GRNNs.

As shown in FIG. 2, a system 10 and method of the present invention employs GRNNs to determine a relative permeability predictions based on reservoir data of a hydrocarbon reservoir. The system 10 includes a computer-based system 12 for receiving input reservoir data for a hydrocarbon reservoir to be processed and to generate outputs through the output device 16, including a relative permeability prediction 18. The output device 16 can be any known type of display, a printer, a plotter, and the like, for displaying or printing the relative permeability prediction 18 as numerical values, a two-dimensional graph, or a three-dimensional image of the hydrocarbon reservoir, with known types of indications of relative permeability in the hydrocarbon reservoir, such as different colors or heights of a histogram indicating higher relative permeability as measured in different geographically in regions of the hydrocarbon reservoir.

The computer-based system 12 includes a processor 20 operating predetermined software 22 for receiving and processing the input reservoir data 14, and for implementing a trained GRNN 24. The GRNN 24 can be implemented in hardware and/or software. For example, the GRNN 24 can be a predetermined GRNN software program incorporated into or operating with the predetermined software executed by the processor 20. Alternatively, the processor 20 can implement the GRNN 24 in hardware, such as a customized ANN or GRNN circuit incorporated into or operating with the processor 20.

The computer-based system 12 can also include a memory 26 and other hardware and/or software components operating with the processor 20 to implement the system 10 and method of the present invention.

Design and Development of ANN Models

In regression problems, the objective is to estimate the value of a continuous variable given the known input variables. Regression problems can be solved using the following network types: Multilayer Perceptrons (MLP), Radial Basis Function (RBF), Generalized Regression Neural Network (GRNN), and Linear. In developing the present invention, analysis and comparisons were made of the first three types: MLP, RBF, and GRNN. The Linear model is basically the conventional linear regression analysis. Since the problem of determining relative permeability in a hydrocarbon reservoir is a regression type and because of the power and advantages of GRNNs, GRNN is superior in implementing the present invention.

Figure 3:
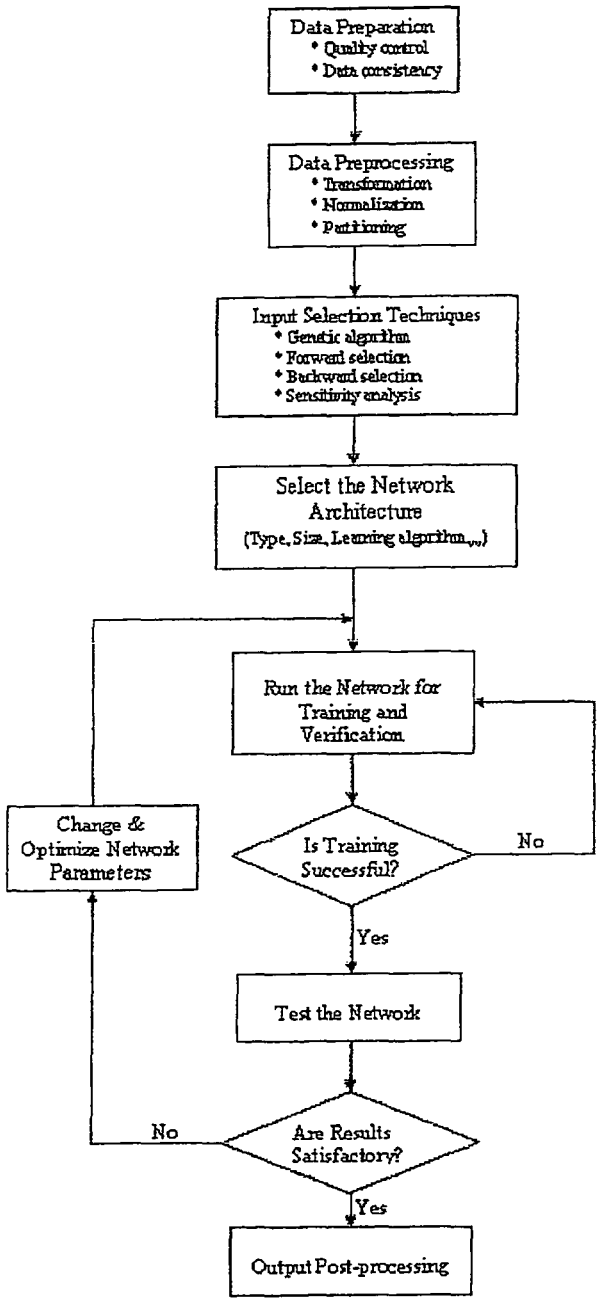
FIG. 3 is a flowchart of the operation of the artificial neural networks used in the present invention.
Figure 4:
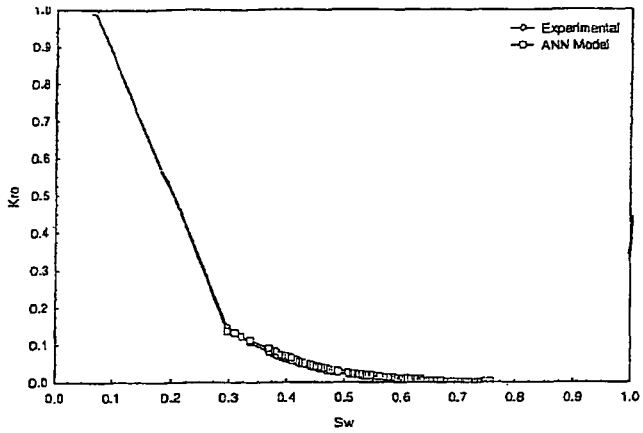
FIGS. 4-8 are graphs showing that the results of ANN models compared with the experimental data.
Figure 5:
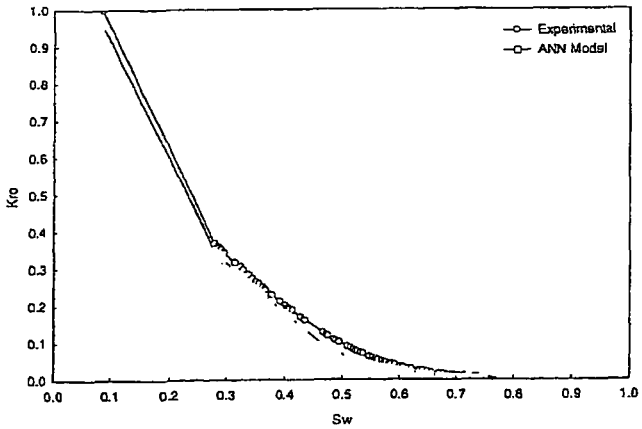
Figure 6:
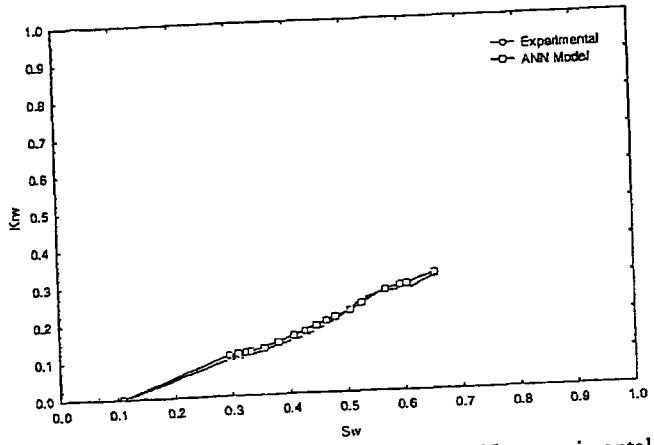
Figure 7:
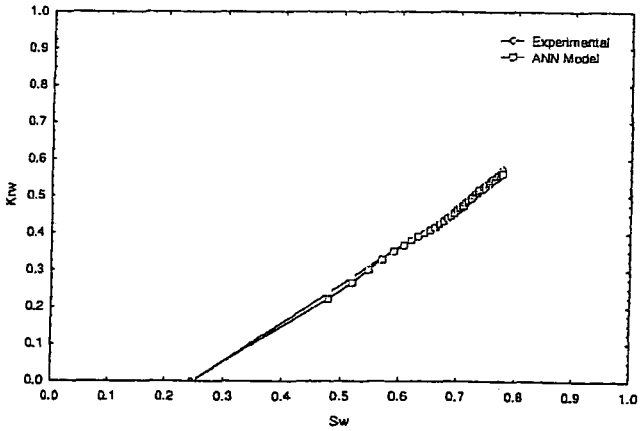
Figure 8:
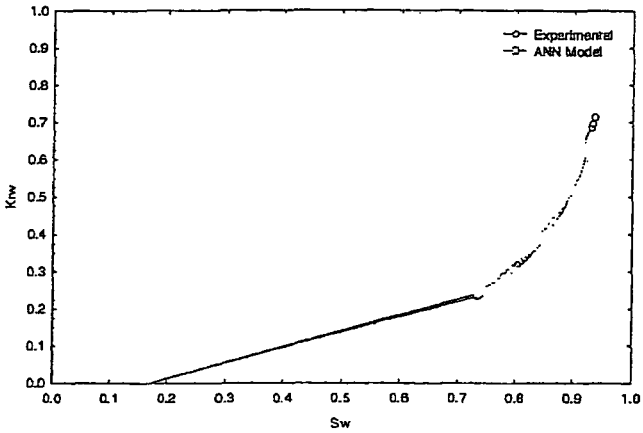

There are several important procedures that must be taken into consideration during the design and development of an ANN model. FIG. 3 is a flowchart illustrating the ANN development strategies considered and implemented in developing the present invention.

Data Preparation

In implementing the present invention, the GRNN 24 is initially trained, for example, using the steps and procedures shown in FIG. 3.

Data acquisition, preparation, and quality control are considered the most important and most time-consuming tasks, with the various steps shown in FIG. 3. The amount of data required for training a neural network frequently presents difficulties. There are some heuristic rules, which relate the number of data points needed to the size of the network. The simplest of these indicates that there should be ten times as many data points as connections in the network. In fact, the number needed is also related to the complexity of the underlying function which the network is trying to model, and to the variance of the additive noise. As the number of variables increases, the number of data points required increases nonlinearly, so that for even a fairly small number of variables, e.g., fifty or less, a very large number of data points are required. This problem is known as "the curse of dimensionality." If there is a larger, but still restricted, data set, then it can be compensated to some extent by forming an ensemble of networks, each network being trained using a different re-sampling of the available data and then averaging across the predictions of the networks in the ensemble.

Water-oil relative permeability measurements were collected for all wells having special core analysis (SCAL) of carbonate reservoirs in Arabian oil fields. These included eight reservoirs from six major fields. SCAL reports were thoroughly studied, and each relative permeability curve was carefully screened, examined, and checked for consistency and reliability. As a result, a large database of water-oil relative permeability data for carbonate reservoirs was created for training the GRNN 24. All relative permeability experimental data measurements were conducted using the unsteady state method.

Developing ANN models for water-oil relative permeability with easily obtainable input variables is one of the objectives of the present invention. Initial water saturation, residual oil saturation, porosity, well location and wettability are the main input variables that significantly contribute to the prediction of relative permeability data. From these input variables, several transformational forms or functional links were made which play a role in predicting the relative permeability. The initial water saturation, residual oil saturation, and porosity of each well can be obtained from either well logs or routine core analysis. Wettability is an important input variable for predicting the relative permeability data and is included in the group of input variables. However, not all wells with relative permeability measurements have wettability data. For those wells without wettability data, "Craig's rule" was used to determine the wettability of each relative permeability curve which is classified as oil-wet, water-wet, or mixed wettability.

The determination of Craig's rule is described in Craig, F. F., "The Reservoir Engineering Aspects of Waterflooding", Richardson, Tex.: SPE Press, 1971. If no information is available on the wettability of a well, then it can be estimated using offset wells data or sensitivity analysis can be performed. The output of each network in this study is a single variable, i.e., either water or oil relative permeability.

Due to the variety of reservoir characteristics and use of data statistics, the database was divided into three categories of reservoirs: A reservoir, "B" reservoir, and all other reservoirs having limited data. This necessitated the development of six ANN models for predicting water and oil relative permeability resulting in two ANN models for each reservoir category.

Data Preprocessing

Data preprocessing is an important procedure in the development of ANN models and for training the GRNN 24 in accordance with the present invention. All input and output variables must be converted into numerical values for introduction into the network. Nominal values require special handling. Since the wettability is a nominal input variable so it is converted into a set of numerical values. That is, oil-wet was represented as [1, 0, 0], mixed-wet as [0, 1, 0], and water-wet as [0, 0, 1]. In this study, two normalization algorithms were applied: mean/standard deviation, and minimax to ensure that the network's input and output will be in a sensible range. The simplest normalization function is minimax which finds the minimum and maximum values of a variable in the data and performs a linear transformation using a shift and a scale factor to convert the values into the target range which is typically [0.0, 1.0]. After network execution, de-normalizing of the output follows the reverse procedure: subtraction of the shift factor, followed by division by the scale factor. The mean/standard deviation technique is defined as the data mean subtracted from the input variable value divided by the standard deviation. Both methods have advantages that they process the input and output variables without any loss of information and their transform is mathematically reversible.

Input Selection and Dimensionality Reduction

One of the tasks to be completed in the design of the neural network used in the present invention is determining which of the available variables to use as inputs to the neural network. The only guaranteed method to select the best input set is to train networks with all possible input sets and all possible architectures, and to select the best. Practically, this is impossible for any significant number of candidate input variables. The problem is further complicated when there are interdependencies or correlations between some of the input variables, which means that any of a number of subsets might be adequate.

To some extent, some neural network architectures can actually learn to ignore useless variables. However, other architectures are adversely affected, and in all cases a larger number of inputs imply that a larger number of training cases are required to prevent over-learning. As a consequence, the performance of a network can be improved by reducing the number of input variables, even though this choice is made with the risk of losing some input information. However, as described below, highly sophisticated algorithms can be utilized in the practice of the invention that determines the selection of input variables. The following describes the input selection and dimensionality reduction techniques used in the method of the invention.

Genetic Algorithm

Genetic algorithms are optimization algorithms that can search efficiently for binary strings by processing an initially random population of strings using artificial mutation, and crossover and selection operators in a process analogous to natural selection. See, Goldberg, D. E., "Genetic Algorithms", Reading, Mass.: Addison Wesley, 1989. The process is applied in developing the present invention to determine an optimal set of input variables which contribute significantly to the performance of the neural network. The method is used as part of the model-building process where variables identified as the most relevant are then used in a traditional model-building stage of the analysis. The genetic algorithm method is a particularly effective technique for combinatorial problems of this type, where a set of interrelated "yes/no" decisions must be made. In developing the present invention, it is used to determine whether or not the input variable under evaluation is significantly important. The genetic algorithm is therefore a good alternative when there are large numbers of variables, e.g., more than fifty, and also provides a valuable second opinion for smaller numbers of variables. The genetic algorithm is particularly useful for identifying interdependencies between variables located close together on the masking strings. The genetic algorithm can sometimes identify subsets of inputs that are not discovered by other techniques. However, the method can be time-consuming, since it typically requires building and testing many thousands of networks.

Forward and Backward Stepwise Algorithms

Stepwise algorithms are usually less time-consuming than the genetic algorithm if there are a relatively small number of variables. They are also equally effective if there are not too many complex interdependencies between variables. Forward and backward stepwise input selection algorithms work by adding or removing variables one at a time.

Forward selection begins by locating the single input variable that, on its own, best predicts the output variable. It then checks for a second variable that when added to the first most improves the model. The process is repeated until either all of the variables have been selected, or no further improvement is made. Backward stepwise feature selection is the reverse process; it starts with a model including all variables, and then removes them one at a time, at each stage finding the variable that, when it is removed, least degrades the model.

Forward and backward selection methods each have their advantages and disadvantages. The forward selection method is generally faster. However, it may miss key variables if they are interdependent or correlated. The backward selection method does not suffer from this problem, but as it starts with the whole set of variables, the initial evaluations are the most time-consuming. Furthermore, the model can actually suffer purely from the number of variables, making it difficult for the algorithm to behave sensibly if there are a large number of variables, especially if there are only a few weakly predictive ones in the set. In contrast, because it selects only a few variables initially, forward selection can succeed in this situation. Forward selection is also much faster if there are few relevant variables, as it will locate them at the beginning of its search, whereas backwards selection will not whittle away the irrelevant ones until the very end of its search.

In general, backward selection is to be preferred if there are a relatively small number of variables (e.g., twenty or less), and forward selection may be better for larger numbers of variables. All of the above input selection algorithms evaluate feature selection masks. These are used to select the input variables for a new training set, and the GRNN 24 is tested on this training set. The use of this form of network is preferred for several reasons. GRNNs usually train extremely quickly, making the large number of evaluations required by the input selection algorithm feasible; it is capable of modeling nonlinear functions quite accurately; and it is relatively sensitive to the inclusion of irrelevant input variables. This is a significant advantage when trying to decide whether particular input variables are required.

Sensitivity Analysis

Sensitivity analysis is performed on the inputs to a neural network to indicate which input variables are considered most important by that particular neural network. Sensitivity analysis can be used purely for informational purposes, or to perform input pruning to remove excessive neurons from input or hidden layers. In general, input variables are not independent. Sensitivity analysis gauges variables according to the deterioration on modeling performance that occurs if that variable is not available to the model. However, the interdependence between variables means that no scheme of single ratings per variable can ever reflect the subtlety of the true situation. In addition, there may be interdependent variables that are useful only if included as a set. If the entire set is included in a model, they can be accorded significant sensitivity, but this does not reveal their interdependency. Worse, if only part of the interdependent set is included, their sensitivity will be zero, as they carry no discernable information.

From the above, it will be understood by one of ordinary skill in the art that precautions are to be exercised when drawing conclusions about the importance of variables, since sensitivity analysis does not rate the usefulness of variables in modeling in a reliable or absolute manner. Nonetheless, in practice, sensitivity analysis is extremely useful.

If a number of models are studied, it is often possible to identify variables that are always of high sensitivity, others that are always of low sensitivity and ambiguous variables that change ratings and probably carry mutually redundant information.

Another common approach to dimensionality reduction is the principle component analysis, described by Bishop in 1995, which can be represented in a linear network. It can often extract a very small number of components from quite high-dimensional original data and still retain the important structure.

Training, Verifying and Testing

By exposing the GRNN 24 repeatedly to input data during training, the weights and thresholds of the post-synaptic potential function are adjusted using special training algorithms until the network performs very well in correctly predicting the output. In the present embodiment, the data are divided into three subsets: training set (50% of data), verification or validation set (25% of data), and testing set (25% of data). The training data subset can be presented to the network in several or even hundreds of iterations. Each presentation of the training data to the network for adjustment of weights and thresholds is referred to as an epoch. The procedure continues until the overall error function has been sufficiently minimized. The overall error is also computed for the second subset of the data which is sometimes referred to as the verification or validation data. The verification data acts as a watchdog and takes no part in the adjustment of weights and thresholds during training, but the networks' performance is continually checked against this subset as training continues. The training is stopped when the error for the verification data stops decreasing or starts to increase. Use of the verification subset of data is important, because with unlimited training, the neural network usually starts "overlearning" the training data. Given no restrictions on training, a neural network may describe the training data almost perfectly, but will generalize very poorly to new data. The use of the verification subset to stop training at a point when generalization potential is best is a critical consideration in training neural networks. The decision to stop training is based upon a determination that the network error is (a) equal to, or less than a specified tolerance error, (b) has exceeded a predetermined number of iterations, or (c) when the error for the verification data either stops decreasing or beings to increase.

A third subset of testing data is used to serve as an additional independent check on the generalization capabilities of the neural network, and as a blind test of the performance and accuracy of the network. Several neural network architectures and training algorithms have been applied and analyzed to achieve the best results. The results were obtained using a hybrid approach of genetic algorithms and the neural network.

All of the six types of networks reviewed during development of the present invention were successfully well trained, verified and checked for generalization. An important measure of the network performance is the plot of the root-mean-square error versus the number of iterations or epochs. A well-trained network is characterized by decreasing errors for both the training, and verification data sets as the number of iterations increases, as described in Al-Fattah and Startzman in 2003.

Statistical analyses used in this embodiment to examine the performance of a network are the output data standard deviation, output error mean, output error standard deviation, output absolute error mean, standard deviation ratio, and the Pearson-R correlation coefficient. The most significant parameter is the standard deviation (SD) ratio that measures the performance of the neural network. It is the best indicator of the goodness, e.g., accuracy, of a regression model and it is defined as the ratio of the prediction error SD to the data SD. One minus this regression ratio is sometimes referred to as the "explained variance" of the model. It will be understood that the explained variance of the model is the proportion of the variability in the data accounted for by the model, and also reflects the sensitivity of the modeling procedure to the data set chosen. The degree of predictive accuracy needed varies from application to application. However, a SD ratio of 0.2 or lower generally indicates a very good regression performance network. Another important parameter is the standard Pearson-R correlation coefficient between the network's prediction and the observed values. A perfect prediction will have a correlation coefficient of 1.0. In developing the present invention, the network verification data subset was used to judge and compare the performance of one network among other competing networks.

Due to the large proportion of its data (70% of database), most of the results belong to the ANN models developed for the A reservoir. Tables 1 and 2 present the statistical analysis of the ANN models for determining oil and water relative permeability, respectively, for the A reservoir. Both tables show that the A reservoir ANN models for predicting oil relative permeability achieved a high degree of accuracy by having low values of SD ratios, i.e., that are lower than 0.2 for all data subsets including training, verification, and testing data sets. Tables 1 and 2 also show that a correlation coefficient of 0.99 was achieved for all data subsets of the A reservoir model, indicating the high accuracy of the ANN models for predicting the oil and water relative permeability data.

TABLE 1

Statistical analysis of ANN model for Kro A reservoir

| | Training | Verification | Testing |
|---|---|---|---|
| Data S.D. | 0.198159 | 0.133331 | 0.214694 |
| Error Mean | −4.47E−05 | 0.002488 | −0.000804 |
| Error S.D. | 0.019920 | 0.014860 | 0.032760 |
| Abs. E. Mean | 0.004571 | 0.005582 | 0.009307 |
| S.D. Ratio | 0.100502 | 0.111487 | 0.152606 |
| Correlation-R | 0.994949 | 0.993845 | 0.988549 |

TABLE 2

Statistical analysis of ANN model for Krw A reservoir

| | Training | Verification | Testing |
|---|---|---|---|
| Data S.D. | 0.286049 | 0.285113 | 0.286381 |
| Error Mean | 3.46E−04 | 0.003256 | 0.001453 |
| Error S.D. | 0.015650 | 0.037490 | 0.046110 |
| Abs. E. Mean | 0.009336 | 0.022010 | 0.025480 |
| S.D. Ratio | 0.054720 | 0.131509 | 0.161010 |
| Correlation-R | 0.998520 | 0.991527 | 0.986983 |

Figure 9:
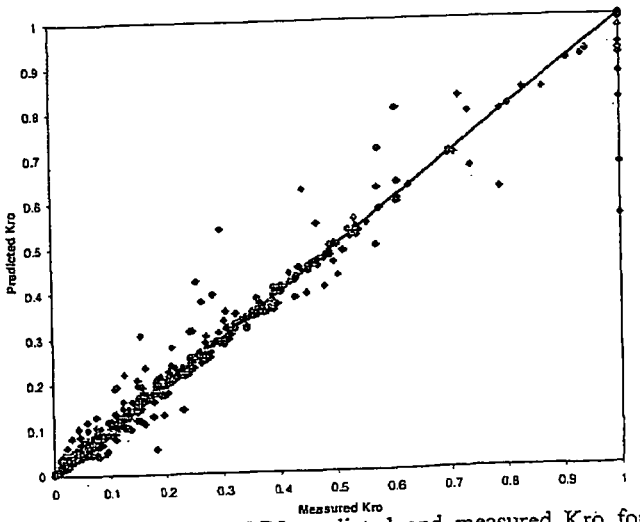
FIGS. 9 and 10 are crossplots of measured versus predicted data for oil and water relative permeability.
Figure 10:
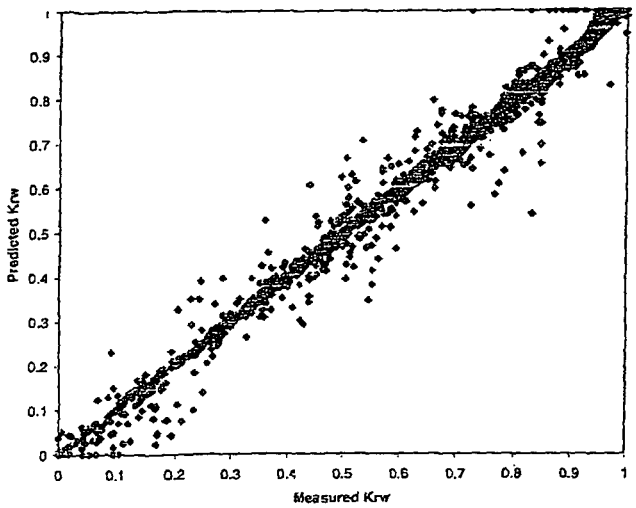
Figure 11:
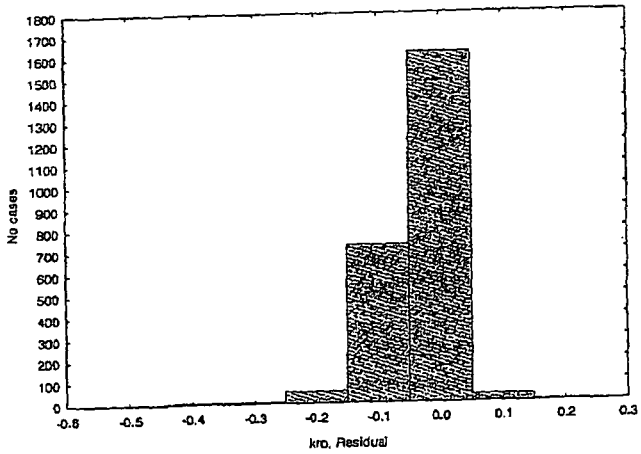
FIGS. 11 and 12 are histograms of residual errors for oil and water relative permeability ANN models.
Figure 12:
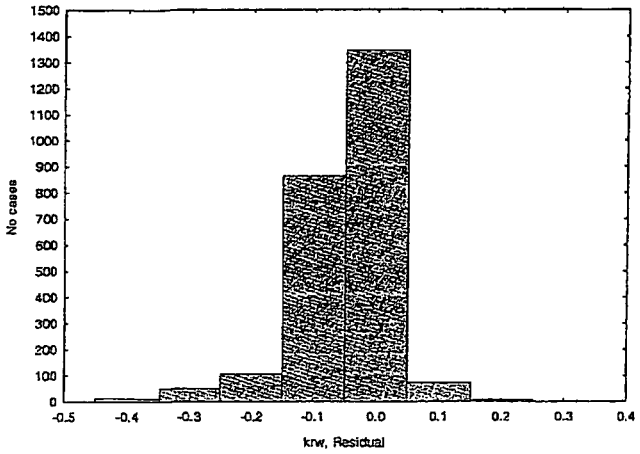

FIGS. 4-8 show that the results of ANN models are in excellent agreement with the experimental data of oil and water relative permeability. Crossplots of measured versus predicted data of oil and water relative permeability are presented in FIGS. 9 and 10, respectively. The majority of the data fall close to the 45° straight line, indicating the high degree of accuracy of the ANN models. FIGS. 11 and 12 are histograms of residual errors of oil and water relative permeability ANN models for the A reservoir.

Comparison of ANN to Correlations

The ANN models of the invention for predicting water-oil relative permeability of carbonate reservoirs were validated using data that were not utilized in the training of the ANN models. This step was performed to examine the applicability of the ANN models and to evaluate their accuracy when compared to prior correlations published in the literature. The new ANN models were compared to published correlations described in Wyllie, M. R. J., "Interrelationship between Wetting and Nonwetting Phase Relative Permeability", Trans. AIME 192: 381-82, 1950; Pierson, S. J., "Oil Reservoir Engineering", New York: McGraw-Hill Book Co. Inc., 1958; Naar, J., Wygal, R. I., Henderson, J. H., "Imbibition Relative Permeability in Unconsolidated Porous Media", SPEJ 2 (1): 254-58, SPE-213-PA, DOI: 10.2118/213-PA, 1962; Jones, S. C. and Roszelle, W. O., "Graphical Techniques for Determining Relative Permeability from Displacement Experiments", JPT 30 (5): 807-817, SPE-6045-PA, DOI: 10.2118/6045-PA, 1978; Land, C. S., "Calculation of Imbibition Relative Permeability for Two- and Three-Phase Flow from Rock Properties", SPEJ 8 (5): 149-56, SPE-1942-PA, DOI: 10.2118/1942-PA, 1968; Honarpour, M., Koederitz, L., and Harvey, A H., "Relative Permeability of Petroleum Reservoirs", Boca Raton: CRC Press Inc., 1986; and Honarpour, M., Koederitz, L., and Harvey, A. H, "Empirical Equations for Estimating Two-Phase Relative Permeability in Consolidated Rock", JPT 34 (12): 2905-2908, SPE-9966-PA, DOI: 10.21 18/9966-PA, 1982.

Figure 13:
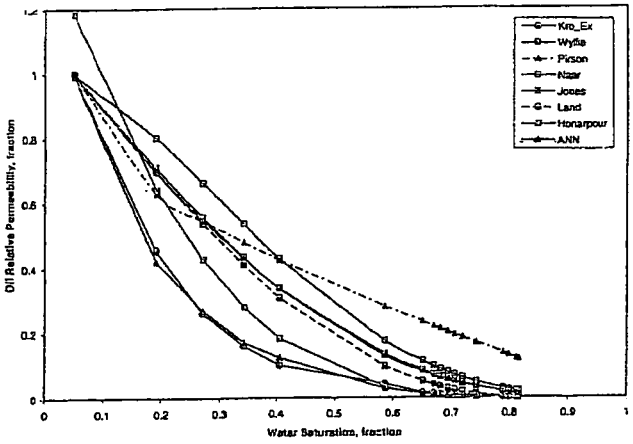
FIGS. 13 and 14 are graphs showing the results of comparison of ANN models against published correlations for predicting oil relative permeability.

FIG. 13 shows the results of the comparison of ANN model to the published correlations for predicting oil relative permeability for one of the oil wells in a carbonate reservoir. The results of the comparison showed that the ANN models of the present invention more accurately reproduced the experimental relative permeability data than the published correlations.

Although correlations shown in Honarpour 1986 gave the closest results to the experimental data among other correlations, it does not honor the oil relative permeability data at the initial water saturation by yielding a value greater than one.

Figure 14:
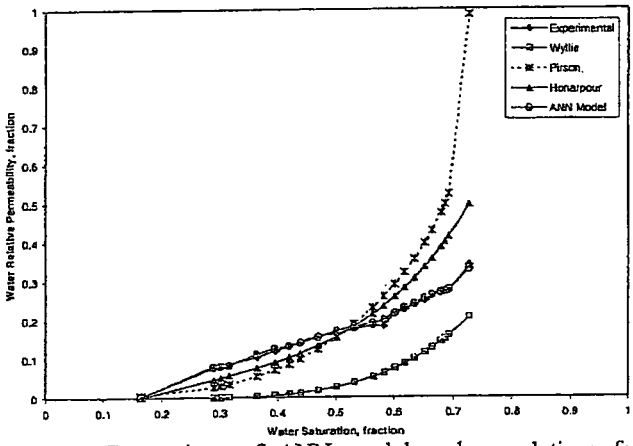

FIG. 14 presents a comparison of results of ANN models against the correlations for predicting water relative permeability data for an oil well in the C field. The results clearly show the high degree of agreement of the ANN model with the experimental data and the high degree of accuracy achieved by the ANN model compared to all published correlations considered in this embodiment.

The system 10 and method of the present invention provides new prediction models for determining water-oil relative permeability using artificial neural network modeling technology for giant and complex carbonate reservoirs that compare very favorably with those of the prior art. The ANN models employ a hybrid of genetic algorithms and artificial neural networks. As shown above, the models were successfully trained, verified, and tested using the GRNN algorithm. Variables selection and dimensionality reduction techniques, a critical procedure in the design and development of ANN models, have been described and applied in this embodiment.

Analysis of results of the blind testing data set of all ANN models show excellent agreement with the experimental data of relative permeability. Results showed that the ANN models, and in particular GRNNs, outperformed all published empirical equations by achieving excellent performance and a high degree of accuracy.

Accordingly, the present invention provides a system 10 and method using a trained GRNN 24 which is trained from reservoir test data and test relative permeability data and then used to process actual reservoir data 14 and to generate a prediction of relative permeability 18 of the actual hydrocarbon reservoir rock. Once the GRIN 24 has been trained in a test environment, the system 10 can be used in the field or it can be implemented remotely to receive the actual reservoir data from the field as the input reservoir data 14, and then perform actual predictions of relative permeability which are displayed or transmitted to personnel in the field during hydrocarbon and/or petroleum production.

While the preferred embodiments of the present invention have been shown and described in detail, it will be apparent that each such embodiment is provided by way of example only. Numerous variations, changes and substitutions will occur to those of ordinary skill in the art without departing from the invention, the scope of which is to be determined by the following claims.

I claim:

1. A system for determining an actual relative permeability value for reservoir rock in a hydrocarbon reservoir comprising:

a processor for receiving, storing and processing actual reservoir data corresponding to the characteristics of the hydrocarbon reservoir, the processor including:

a trained generalized regression neural network trained using test reservoir data and test relative permeability values, with the trained generalized regression neural network for processing the actual reservoir data to determine a relative permeability prediction of an actual relative permeability in the hydrocarbon reservoir from the actual reservoir data; and an output device for outputting the relative permeability prediction.

2. The system of claim 1, wherein the trained generalized regression neural network is trained to have a ratio of a predictive error standard deviation to a standard deviation of the test reservoir data that is less than or equal to 0.2.

3. The system of claim 1, wherein the trained generalized regression neural network is trained to have a standard Pearson-R correlation coefficient between a predicted permeability of the test reservoir data and the observed permeability of the test reservoir data that is at least 0.99.

4. The system of claim 1, wherein the output device outputs the relative permeability prediction as a numerical value.

5. The system of claim 1, wherein the output device displays the output of the relative permeability prediction as a graphical representation.

6. The system of claim 5, wherein the relative permeability prediction is displayed on a two-dimensional graph.

7. The system of claim 5, wherein the graphical display is a three-dimensional image of the hydrocarbon reservoir.

8. The system of claim 5, wherein the graphical representation includes different colors indicating higher relative permeability as measured in different geographical regions of the hydrocarbon reservoir.

9. The system of claim 5, wherein the graphical representation includes different heights of a histogram indicating higher relative permeability as measured in different geographical regions of the hydrocarbon reservoir.

10. A computer program product for determining an actual relative permeability in a hydrocarbon reservoir, the computer program product comprising a non-transitory computer readable medium having computer readable program code embodied therein that, when executed by a processor, causes the processor:

to establish a plurality of computing nodes trained from test reservoir data and test relative permeability values, whereby the plurality of computing nodes, after training, processes actual reservoir data to determine a relative permeability prediction of an actual relative permeability in the hydrocarbon reservoir from the actual reservoir data; and to output the relative permeability prediction.

11. The computer program product of claim 10, wherein the plurality of computing nodes are trained to have a ratio of a predictive error standard deviation to a standard deviation of the test reservoir data that is less than or equal to 0.2.

12. The computer program product of claim 10, wherein the plurality of computing nodes are trained to have a standard Pearson-R correlation coefficient between a predicted relative permeability of the test reservoir data and the observed relative permeability of the test reservoir data that is at least 0.99.

13. A method for determining an actual relative permeability value for reservoir rock in a hydrocarbon reservoir comprising the steps of:

training a generalized regression neural network using test reservoir data and test relative permeability values;

receiving actual reservoir data corresponding to the hydrocarbon reservoir;

inputting the actual reservoir data to the trained generalized regression neural network;

determining a relative permeability prediction of an actual relative permeability in the hydrocarbon reservoir from the actual reservoir data; and outputting the relative permeability prediction through an output device.

14. The method of claim 13, wherein the step of training the generalized regression neural network includes training to have a ratio of a predictive error standard deviation to a standard deviation of the test reservoir data that is less than or equal to 0.2.

15. The method of claim 13, wherein the step of training the generalized regression neural network includes training to have a standard Pearson-R correlation coefficient between a predicted relative permeability of the test reservoir data and the observed relative permeability of the test reservoir data that is at least 0.99.

16. The method of claim 13, wherein the step of outputting includes outputting the relative permeability prediction as a numerical value.

17. The method of claim 13, wherein the step of outputting includes displaying a graphical representation as the output of the relative permeability prediction.

18. The method of claim 17, wherein the step of outputting includes displaying a two-dimensional graph of the relative permeability prediction.

19. The method of claim 17, wherein the step of outputting includes displaying the relative permeability prediction on a three-dimensional image of the hydrocarbon reservoir.

20. The method of claim 17, wherein the graphical representation includes different colors indicating higher relative permeability as measured in different geographical regions of the hydrocarbon reservoir.

21. The method of claim 17, wherein the graphical representation includes displaying different heights of a histogram to indicate higher relative permeability as measured in different geographical regions of the hydrocarbon reservoir.

* * * * *